US010854159B2

(12) United States Patent
Chang et al.

(10) Patent No.: US 10,854,159 B2
(45) Date of Patent: Dec. 1, 2020

(54) DISPLAY APPARATUS

(71) Applicant: Au Optronics Corporation, Hsinchu (TW)

(72) Inventors: Heng-Hao Chang, Hsinchu (TW); Chun-Hao Huang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/414,797

(22) Filed: May 17, 2019

(65) Prior Publication Data

US 2020/0111434 A1 Apr. 9, 2020

(30) Foreign Application Priority Data

Oct. 4, 2018 (TW) ..... 107135018 A

(51) Int. Cl.
*G09G 3/36* (2006.01)

(52) U.S. Cl.
CPC ..... *G09G 3/3674* (2013.01)

(58) Field of Classification Search
CPC ..... G09G 3/3674
See application file for complete search history.

(56) References Cited

U.S. PATENT DOCUMENTS 9,734,785 B2 8/2017 Cho et al.
2013/0147773 A1* 6/2013 Jin ..... G09G 3/30 345/204
2013/0222357 A1* 8/2013 Tseng ..... G09G 3/20 345/212
2014/0347349 A1* 11/2014 Kim ..... G09G 3/3677 345/213
2016/0232866 A1 8/2016 Cho et al.
2018/0239186 A1* 8/2018 Kanehiro ..... B24B 19/26
2018/0374441 A1* 12/2018 Kuo ..... G02F 1/1362

FOREIGN PATENT DOCUMENTS

| | | |
|---|---|---|
| CN | 102376254 | 3/2012 |
| TW | I365318 | 6/2012 |
| TW | 201629932 | 8/2016 |
| TW | M548877 | 9/2017 |
| TW | 201735048 | 10/2017 |

* cited by examiner

*Primary Examiner* — Alexander Eisen
*Assistant Examiner* — Kebede T Teshome
(74) *Attorney, Agent, or Firm* — JCIPRNET

(57) ABSTRACT

A display apparatus includes a plurality of gate drivers, a scan indication signal transmission line, a plurality of subsidiary transmission lines, and a plurality of auxiliary lines. The gate drivers are sequentially coupled in series to each other. The scan indication signal transmission line is configured to transmit a scan indication signal. The subsidiary transmission lines are sequentially coupled between two adjacent gate drivers, respectively. The auxiliary lines are respectively disposed between the scan indication signal transmission line and the subsidiary transmission lines. One of the auxiliary lines is selected to be electrically coupled to the scan indication signal transmission line and the corresponding subsidiary transmission line.

16 Claims, 10 Drawing Sheets

DISPLAY APPARATUS

CROSS-REFERENCE TO RELATED APPLICATION

This application claims the priority benefit of Taiwan application serial no. 107135018, filed on Oct. 4, 2018. The entirety of the above-mentioned patent application is hereby incorporated by reference herein and made a part of this specification.

BACKGROUND OF THE INVENTION

Field of the Invention

The invention generally relates to a display apparatus, and more particularly, to a display apparatus having auxiliary lines.

Description of Related Art

With the popularity of display panels, the display panels can be found on home TVs, e-sports screens, large outdoor billboards, public message screens in stores, and even portable or wearable electronic apparatus. In recent years, the mainstream size of the display panels has been increasing, and in response to consumers' demands for high-end electronic products, many panel manufacturers have been endeavored to develop the display panels with slim borders. In addition, to increase the diversity of product applications, the demands for display panels of special size rather than of the mainstream size are gradually increasing as well.

In a display panel with a slim border, a gate driving circuit is directly formed on a glass substrate, which is the current mainstream technology, i.e., the so-called gate on array (GOA) technology. Thereby, the number of driver integrated circuits (ICs) required by the display panel can be effectively reduced to accomplish a super-slim border design. Besides, in order to meet the production requirements of special-sized display panels and achieve the effective control of production costs, manufacturers are also endeavored to develop the technology of manufacturing display panels of different sizes with use of the same mask.

However, in the display panels formed with use of the same mask, parts of traces of the gate driving circuits configured on glass substrates may also be cut off after a cutting action is performed on the display panels for different sizes, thereby affecting the operation of the gate driving circuits. For instance, termination signals cannot be passed to shift registers of each stage, thus degrading the gate driving circuits after a long period of operation. Therefore, under the demand for performing the cutting action on the substrates of different sizes, how to improve the reliability and production yield of the gate driving circuits of the display panels is an issue intended to be solved in a rapid manner by the manufacturers.

SUMMARY

The invention provides a display apparatus with good reliability.

In an embodiment of the invention, a display apparatus includes a plurality of gate drivers, a scan indication signal transmission line, a plurality of subsidiary transmission lines, and a plurality of auxiliary lines. The gate drivers are sequentially coupled in series to each other. The scan indication signal transmission line is configured to transmit a scan indication signal. The subsidiary transmission lines are sequentially coupled between two adjacent gate drivers, respectively. The auxiliary lines are respectively disposed between the scan indication signal transmission line and the subsidiary transmission lines. One of the auxiliary lines is selected to be electrically coupled to the scan indication signal transmission line and a corresponding subsidiary transmission line of the subsidiary transmission lines.

According to an embodiment of the invention, a first end of the selected auxiliary line in the display apparatus is electrically coupled to the scan indication signal transmission line, and a second end of the selected auxiliary line is electrically coupled to the corresponding subsidiary transmission line. At least one of the first end and the second end of the selected auxiliary line is electrically coupled to the scan indication signal transmission line and the corresponding subsidiary transmission line through welding.

According to an embodiment of the invention, two ends of each of the auxiliary lines are respectively overlapped with the scan indication signal transmission line and the corresponding subsidiary transmission line.

According to an embodiment of the invention, the scan indication signal in the display apparatus is a termination signal.

According to an embodiment of the invention, the display apparatus further includes an insulating layer disposed between the auxiliary lines and the scan indication signal transmission line.

According to an embodiment of the invention, the insulating layer of the display apparatus is disposed between the auxiliary lines and the subsidiary transmission lines.

According to an embodiment of the invention, among the subsidiary transmission lines of the display apparatus, the subsidiary transmission line electrically coupled to the selected auxiliary line has a break point.

According to an embodiment of the invention, the display apparatus further includes a sealing member surrounding a portion of the gate drivers. An orthogonal projection of the selected auxiliary line is located outside an orthogonal projection of the portion of the gate drivers surrounded by the sealing member.

According to an embodiment of the invention, the display apparatus further includes a plurality of protection devices. Each of the auxiliary lines is serially connected to at least one of the protection devices.

According to an embodiment of the invention, the subsidiary transmission line of the display apparatus is coupled between an $n^{th}$ gate driver and an $(n+1)^{th}$ gate driver of the gate drivers, and the break point of the subsidiary transmission line is located between the selected auxiliary line and the $(n+1)^{th}$ gate driver.

According to an embodiment of the invention, the display apparatus further includes a display area. One portion of the gate drivers and the other portion of the gate drivers are respectively disposed on two opposite sides of the display area.

In view of the above, at least one of the first end and the second end of the selected auxiliary line among the auxiliary lines in the display apparatus provided in one or more embodiments of the invention is electrically coupled to the first scan indication signal transmission line and at least one of the corresponding first subsidiary transmission lines through welding, so that the first scan indication signal is allowed to be transmitted to the gate driver through the selected auxiliary line. As such, the normal operation of the gate drivers can be ensured, and the reliability of the gate drivers which are being operated for a long time can be effectively improved.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles described herein.

DESCRIPTION OF THE EMBODIMENTS

Figure 1:
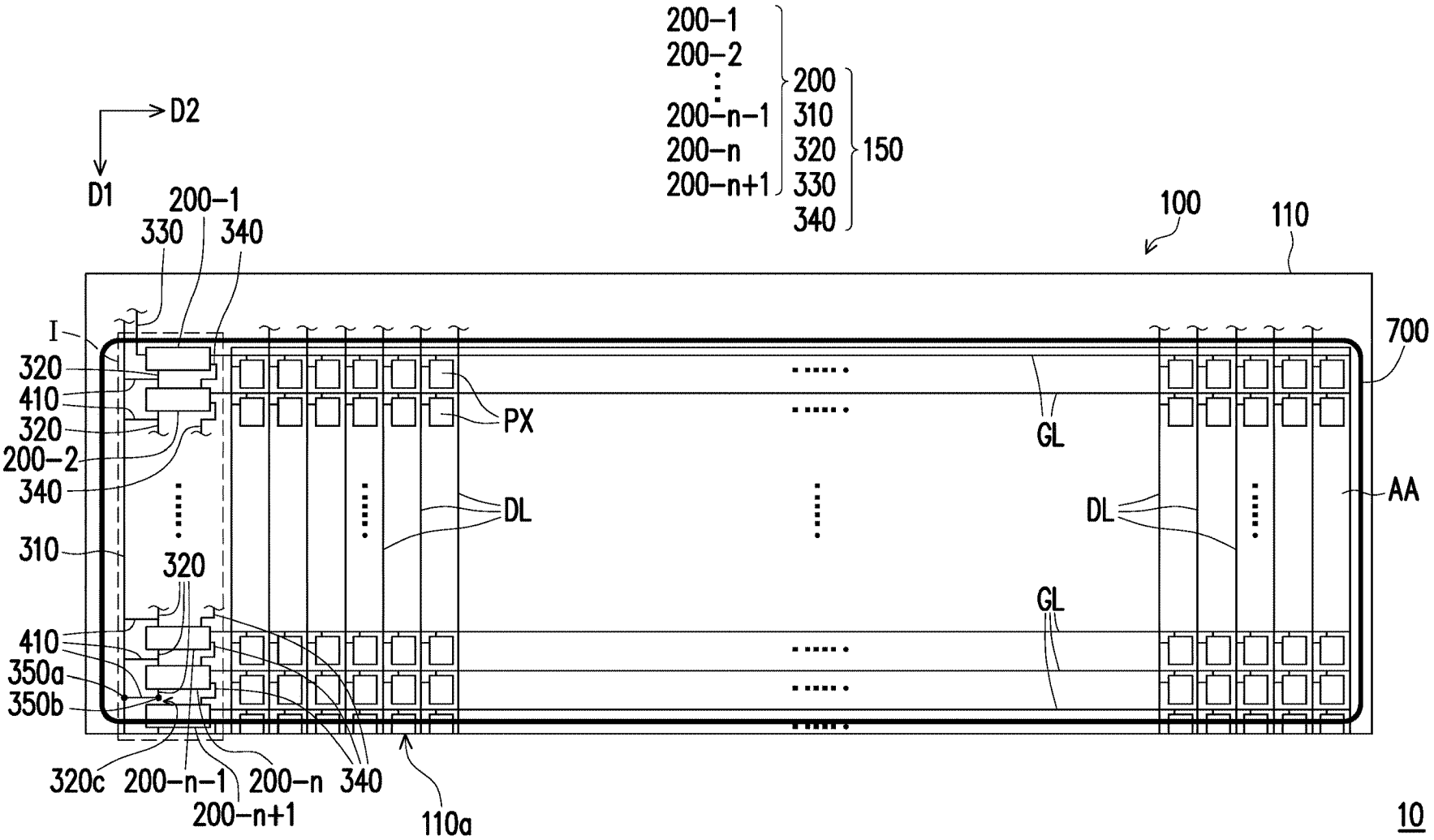
FIG. 1 is a schematic view of a display apparatus according to a first embodiment of the invention.

Throughout the specification, the same reference numerals in the accompanying drawings denote the same devices. In the accompanying drawings, thicknesses of layers, films, panels, regions and so on are exaggerated for clarity. It should be understood that when an element such as a layer, film, region or substrate is referred to as being "on" or "connected to" another device, it can be directly on or connected to the other device, or intervening devices may also be present. In contrast, when a device is referred to as being "directly on" or "directly connected to" another device, there are no intervening devices present. As used herein, the term "connected" may refer to physically connected and/or electrically connected. Furthermore, the "electrical connection" or "coupling" of the two devices may indicate that there are other devices between the two devices. It should be understood that the terms "first," "second," "third," "fourth," "fifth," and "sixth" or "one," "another," and "still another" may be used to describe different elements in the disclosure, but these elements should not be limited by these terms. These terms are only used to distinguish the elements from one another. For instance, a first element may be referred to as a second element; similarly, a second element may be referred to as a first element without departing from the scope of the inventive concept. An element may also be referred to as another element; similarly, another element may be referred to as still another element without departing from the scope of the inventive concept.

The term "about," "approximately," "similar," or "substantially" as used herein is inclusive of the stated value and means within an acceptable range of deviation for the particular value as determined by people having ordinary skill in the art, considering the measurement in question and the error associated with measurement of the particular quantity (i.e., the limitations of the measurement system) or the limitations of the manufacturing system. For instance, "about" may mean within one or more standard deviations, or within, for example, ±30%, ±20%, ±10%, or ±5% of the stated value. Moreover, a relatively acceptable range of deviation or standard deviation may be chosen for the term "about," "approximately," or "substantially" as used herein based on optical properties, etching properties or other properties, instead of applying one standard deviation across all the properties.

Figure 2:
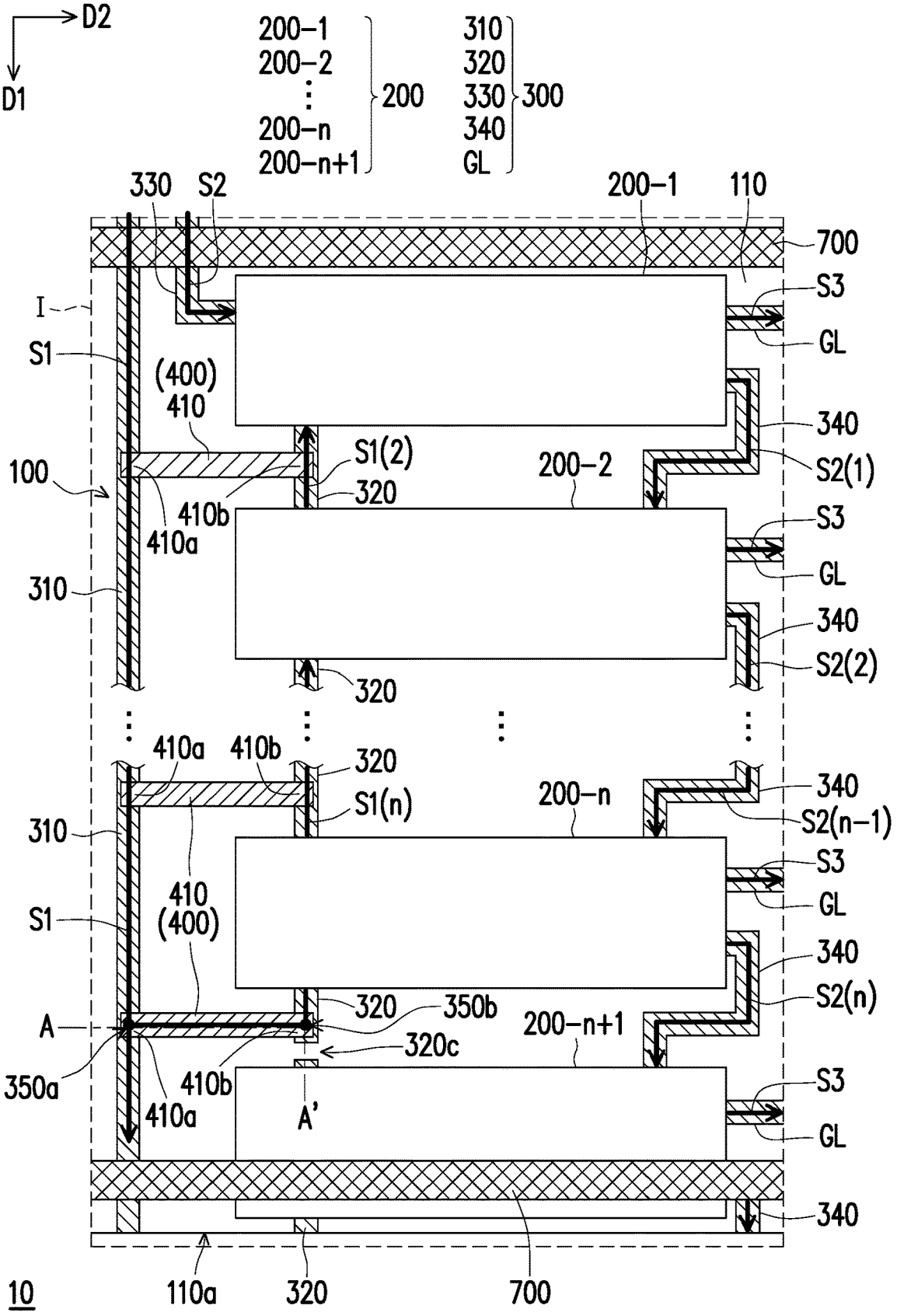
FIG. 2 is a schematic enlarged view of a partial area I of the display apparatus in FIG. 1.
Figure 3:
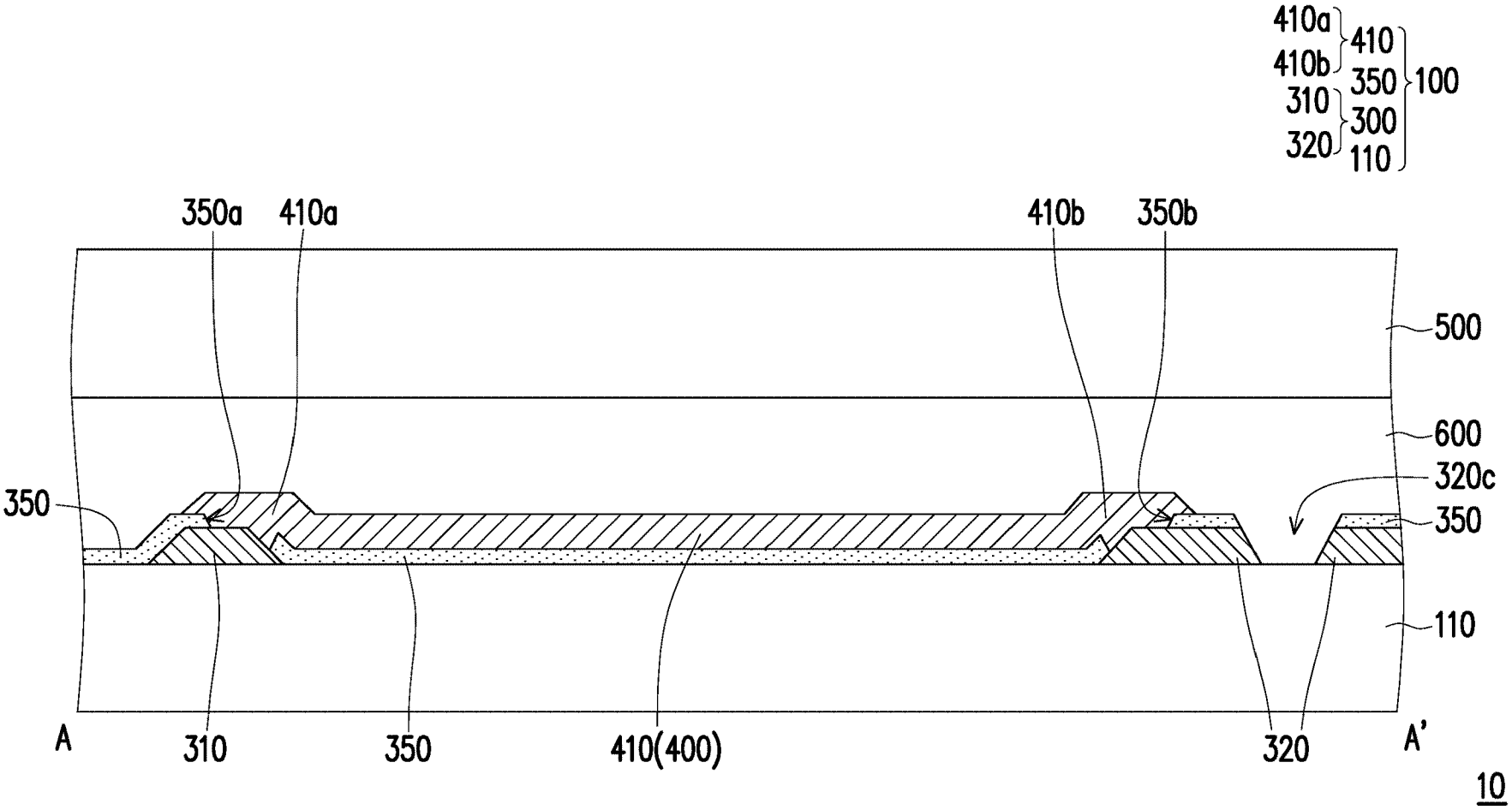
FIG. 3 is a schematic cross-sectional view of the partial area I of the display apparatus in FIG. 2.

FIG. 1 is a schematic view of a display apparatus 10 according to a first embodiment of the invention. FIG. 2 is a schematic enlarged view of a partial area I of the display apparatus 10 in FIG. 1. FIG. 3 is a schematic cross-sectional view of the partial area I of the display apparatus 10 in FIG. 2. FIG. 3 corresponds to a section line A-A' depicted in FIG. 2. Particularly, for clear illustration, first scan indication signals S1, S1(*n*), and S1(2) and second scan indication signals S2, S2(1), S2(2), S2(*n*−1), and S2(*n*) depicted in FIG. 2 are omitted in FIG. 1, and an $(n-1)^{th}$ gate driver 200-*n*−1 depicted in FIG. 1 is omitted in FIG. 2.

With reference to FIG. 1, a display apparatus 10 includes a pixel array substrate 100. The pixel array substrate 100 includes a first substrate 110, a plurality of scan lines GL, and a plurality of data lines DL. The first substrate 110 has a display area AA. The scan lines GL and the data lines DL are alternately disposed in the display area AA. To be specific, the scan lines GL are arranged in a direction D1 on the first substrate 110 and extend in a direction D2. The data lines DL are arranged on the first substrate 110 in the direction D2 and extend in the direction D1. For instance, in the present embodiment, the direction D1 may be substantially perpendicular to the direction D2, which should however not be construed as a limitation to the invention. In the present embodiment, the pixel array substrate 100 further includes a plurality of pixel structures PX. The pixel structures PX may be arranged in array in the display area AA. Each of the pixel structures PX is electrically connected to one corresponding data line DL and one corresponding scan line GL.

The pixel array substrate 100 further includes a first gate driving circuit 150 disposed outside the display area AA of the first substrate 110. The first gate driving circuit 150 includes a plurality of gate drivers 200 sequentially coupled in series to each other. The gate drivers 200 are coupled to the scan lines GL. For instance, in the present embodiment, the number of gate drivers 200 is n+1, wherein n is a positive integer, a first gate driver 200-1 to an $(n+1)^{th}$ gate driver 200-*n*+1 are sequentially arranged on one side of the display area AA along the direction D1, and each of the gate drivers 200 is coupled to one corresponding scan line GL, which should however not be construed as a limitation to the invention.

In the present embodiment, note that the $(n+1)^{th}$ gate driver 200-*n*+1 located between an $n^{th}$ gate driver 200-*n* and one side 110*a* of the first substrate 110 may be a dummy gate driver 200. However, the invention is not limited thereto;

according to other embodiments, the gate drivers 200 may not include any dummy gate driver.

With reference to FIG. 1 and FIG. 2, the first gate driving circuit 150 further includes a first scan indication signal transmission line 310 and a plurality of first subsidiary transmission lines 320. The first scan indication signal transmission line 310 is configured to transmit a first scan indication signal S1. The first subsidiary transmission lines 320 are sequentially coupled between two adjacent gate drivers 200. For instance, in the present embodiment, the first scan indication signal transmission line 310 may be selectively coupled to the $n^{th}$ gate driver 200-*n*, which should however not be construed as a limitation to the invention. According to other embodiments, the first scan indication signal transmission line 310 may also be coupled to the first gate driver 200-1.

For instance, in the present embodiment, the first scan indication signal transmission line 310 is configured to transmit the first scan indication signal S1 to the $n^{th}$ gate driver 200-*n*. The $n^{th}$ gate driver 200-*n* then outputs a first scan indication signal S1(*n*) which is transmitted to the $(n-1)^{th}$ gate driver 200-*n*−1 through the first subsidiary transmission line 320 coupled to the $n^{th}$ gate driver 200-*n* and the $(n-1)^{th}$ gate driver 200-*n*−1, and the rest may be deduced therefrom. After the second gate driver 200-2 outputs a first scan indication signal S1(2) which is transmitted to the first gate driver 200-1 through the first subsidiary transmission line 320 coupled to the second gate driver 200-2 and the first gate driver 200-1, the transmission of the first scan indication signal S1 is completed.

The first gate driving circuit 150 may also include a second scan indication signal transmission line 330 and a plurality of second subsidiary transmit lines 340. The second scan indication signal transmission line 330 is configured to transmit a second scan indication signal S2. The second subsidiary transmit lines 340 are sequentially coupled between two adjacent gate drivers 200. For instance, in the present embodiment, the second scan indication signal transmission line 330 may be selectively coupled to the first gate driver 200-1, which should however not be construed as a limitation to the invention. According to other embodiments, the second scan indication signal transmission line 330 may also be coupled to the $n^{th}$ gate driver 200-*n*.

For instance, in the present embodiment, the second scan indication signal transmission line 330 is configured to transmit the second scan indication signal S2 to the first gate driver 200-1. The first gate driver 200-1 then outputs the second scan indication signal S2(1) which is transmitted to the second gate driver 200-2 through the second subsidiary transmit line 340 coupled to the first gate driver 200-1 and the second gate driver 200-2, and the rest may be deduced therefrom. After the $n^{th}$ gate driver 200-*n* outputs the second scan indication signal S2(*n*) which is transmitted to the $(n+1)^{th}$ gate driver 200-*n*+1 through the second subsidiary transmit line 340 coupled to the $n^{th}$ gate driver 200-*n* and the $(n+1)^{th}$ gate driver 200-*n*+1, the transmission of the second scan indication signal S2 is completed.

In the present embodiment, the second scan indication signal S2 is, for instance, a start signal configured to enable the gate drivers 200 to sequentially provide a plurality of gate driving signals S3 to the scan lines GL and enable the pixel structures PX coupled to the scan lines GL. The first scan indication signal S1 is, for instance, a termination signal configured to disable the gate drivers 200. That is, the gate drivers 200 provided in the present embodiment sequentially provide the gate driving signals S3 to the scan lines GL in a direction from top to bottom (i.e., the direction D1). However, the invention is not limited thereto; according to other embodiments, the first scan indication signal S1 may also be the start signal, the second scan indication signal S2 may also be the termination signal, and the gate drivers 200 sequentially provide the gate driving signals S3 to the scan lines GL in a direction from bottom to top (i.e., opposite to the direction D1).

The first gate driving circuit 150 further includes a plurality of auxiliary lines 410 respectively disposed between the first scan indication signal transmission line 310 and the first subsidiary transmission lines 320. According to the present embodiment, the auxiliary lines 410 and the gate drivers 200 are alternately arranged in the direction D1. One of the auxiliary lines 410 is selected as a selected auxiliary line 410 which is electrically coupled to the first scan indication signal transmission line 310 and one corresponding first subsidiary transmission line 320. For instance, in the present embodiment, each auxiliary line 410 has a first end 410*a* and a second end 410*b* opposite to each other, and the first end 410*a* and the second end 410*b* of the auxiliary line 410 are respectively overlapped with the first scan indication signal transmission line 310 and one corresponding first subsidiary transmission line 320, which should however not be construed as limitations to the invention. The auxiliary lines 410 alternate with the first scan indication signal transmission line 310 and the first subsidiary transmission lines 320. For instance, in the present embodiment, the auxiliary lines 410 may be substantially perpendicular to the first scan indication signal transmission line 310 and the first subsidiary transmission lines 320, which should however not be construed as a limitation to the invention.

According to the present embodiment, in consideration of conductivity, the first scan indication signal transmission line 310, the first subsidiary transmission lines 320, the second scan indication signal transmission line 330, the second subsidiary transmit lines 340, the auxiliary lines 410, the scan lines GL, and the data lines DL are often made of metallic materials. However, the invention is not limited thereto. According to other embodiments, the first scan indication signal transmission line 310, the first subsidiary transmission lines 320, the second scan indication signal transmission line 330, the second subsidiary transmit lines 340, the auxiliary lines 410, the scan lines GL, and the data lines DL may also be made of other conductive materials, such as alloy, metal nitride, metal oxide, metal oxynitride, other appropriate materials, or a stacked layer having metallic materials and other conductive materials.

For instance, in the present embodiment, the first scan indication signal transmission line 310, the first subsidiary transmission lines 320, the second scan indication signal transmission line 330, the second subsidiary transmit lines 340, and the scan lines GL may be selectively made of the same material; that is, the first scan indication signal transmission line 310, the first subsidiary transmission lines 320, the second scan indication signal transmission line 330, the second subsidiary transmit lines 340, and the scan lines GL may be formed in the same film layer, e.g., a first conductive layer 300; the auxiliary lines 410 and the data lines DL may be selectively made of the same material; that is, the auxiliary lines 410 and the data lines DL may be formed in the same film layer, e.g., a second conductive layer 400. However, the invention is not limited thereto; in other embodiments, the first subsidiary transmission lines 320 and the auxiliary lines 410 may be formed in the same film layer, e.g., a third conductive layer.

With reference to FIG. 3, the pixel array substrate 100 further includes an insulating layer 350 disposed between the first conductive layer 300 and the second conductive layer 400. The insulating layer 350 covers a partial surface of the first substrate 110 and the first conductive layer 300. In the present embodiment, the insulating layer 350 may be made of an inorganic material, an organic material, or any other appropriate material. The inorganic material may be silicon oxide, silicon nitride, silicon oxynitride, or any other appropriate inorganic material; the organic material is, for instance, polyimide (PI) resin, epoxy resin, acrylic resin, or any other appropriate organic material.

With reference to FIG. 2 and FIG. 3, at least one of the first end 410*a* and the second end 410*b* of the selected auxiliary line 410 is electrically coupled to the first scan indication signal transmission line 310 and the corresponding subsidiary transmission line 320 through welding. For instance, in the present embodiment, the first end 410*a* of the selected auxiliary line 410 is welded to the first scan indication signal transmission line 310 through a contact window 350*a* of the insulating layer 350, so as to be electrically coupled to the first scan indication signal transmission line 310; the second end 410*b* of the selected auxiliary line 410 is welded to the corresponding first subsidiary transmission line 320 through the contact window 350*b* of the insulating layer 350, so as to be electrically coupled to the corresponding first subsidiary transmission line 320, which should however not be construed as limitations to the invention.

In other words, through two welding processes, the selected auxiliary line 410 provided in the present embodiment is electrically coupled to the first scan indication signal transmission line 310 and the first subsidiary transmission line 320 coupled between the $n^{th}$ gate driver 200-*n* and the $(n+1)^{th}$ gate driver 200-*n*+1. Thereby, the first scan indication signal S1 may be transmitted to the $n^{th}$ gate driver 200-*n* through the first scan indication signal transmission line 310, the selected auxiliary line 410, and the corresponding first subsidiary transmission line 320; thereafter, the first scan indication signal S1(*n*) is transmitted to the $(n-1)^{th}$ gate driver 200-*n*−1, and the rest may be deduced therefrom. As such, after the pixel array substrate 100 undergoes a cutting process, the reliability of the gate drivers 200-1-200-*n* which are being operated for a long period of time can be effectively improved. According to the present embodiment, the welding process includes laser welding, which should however not be construed as a limitation to the invention.

For instance, in the present embodiment, the first subsidiary transmission line 320 electrically coupled to the selected auxiliary line 410 has a break point 320*c*, which should however not be construed as a limitation to the invention. Specifically, the break point 320*c* of the first subsidiary transmission line 320 coupled between the $n^{th}$ gate driver 200-*n* and the $(n+1)^{th}$ gate driver 200-*n*+1 is formed through cutting. For instance, in the present embodiment, the break point 320*c* of the first subsidiary transmission line 320 is located between the selected auxiliary line 410 and the $(n+1)^{th}$ gate driver 200-*n*+1, which should however not be construed as a limitation to the invention. Note that the break point 320*c* is configured to break the connection of the dummy $(n+1)^{th}$ gate driver 200-*n*+1 and the selected auxiliary line 410. Thereby, signals on the selected auxiliary line 410 can be prevented from be interfered. In the present embodiment, the cutting process includes laser cutting, which should however not be construed as a limitation to the invention.

With reference to FIG. 3, in the present embodiment, the display apparatus 10 may further include a second substrate 500 and a display medium 600. The second substrate 500 is disposed opposite to the first substrate 110. The display medium 600 is sandwiched between the first substrate 110 and the second substrate 500. For instance, in the present embodiment, the first substrate 110 and/or the second substrate 500 may be made of glass, quartz, organic polymer, or other appropriate materials. According to the present embodiment, the display medium 600 is liquid crystal, for instance. However, the invention is not limited thereto; in other embodiments, the display medium 600 may also be an organic electroluminescent layer or may be made of other appropriate materials.

With reference to FIG. 1 and FIG. 2, the display apparatus 10 may further include a sealing member 700 disposed between the pixel array substrate 100 and the second substrate 500 (not shown). The sealing member 700 surrounds the display area AA of the first substrate 110 and a portion of the first gate driving circuit 150. For instance, in the present embodiment, the auxiliary line 410 welded to the first scan indication signal transmission line 310 and the break point 320*c* of the first subsidiary transmission line 320 are located in an orthogonal projection of the region surrounded by the sealing member 700 in the first substrate 110, which should however not be construed as a limitation to the invention. According to the present embodiment, the material of the sealing member 700 may be selected from epoxy resin, polymethyl methacrylate (PMMA), a glass material (frit), silicon oxide, boron, bismuth, or a combination thereof, which should however not be construed as a limitation to the invention.

Figure 4:
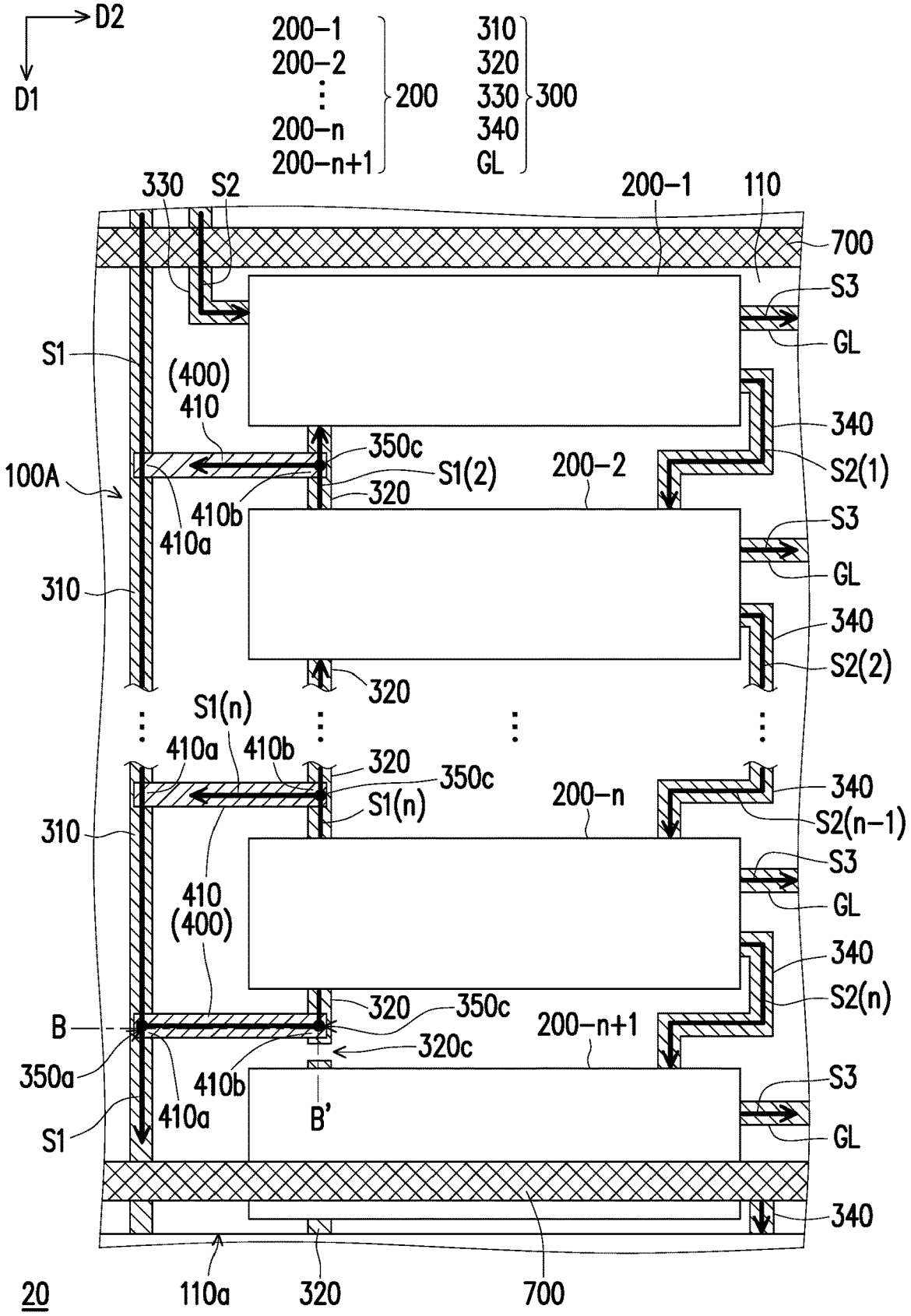
FIG. 4 is a schematic enlarged view of a partial area of a display apparatus according to a second embodiment of the invention.
Figure 5:
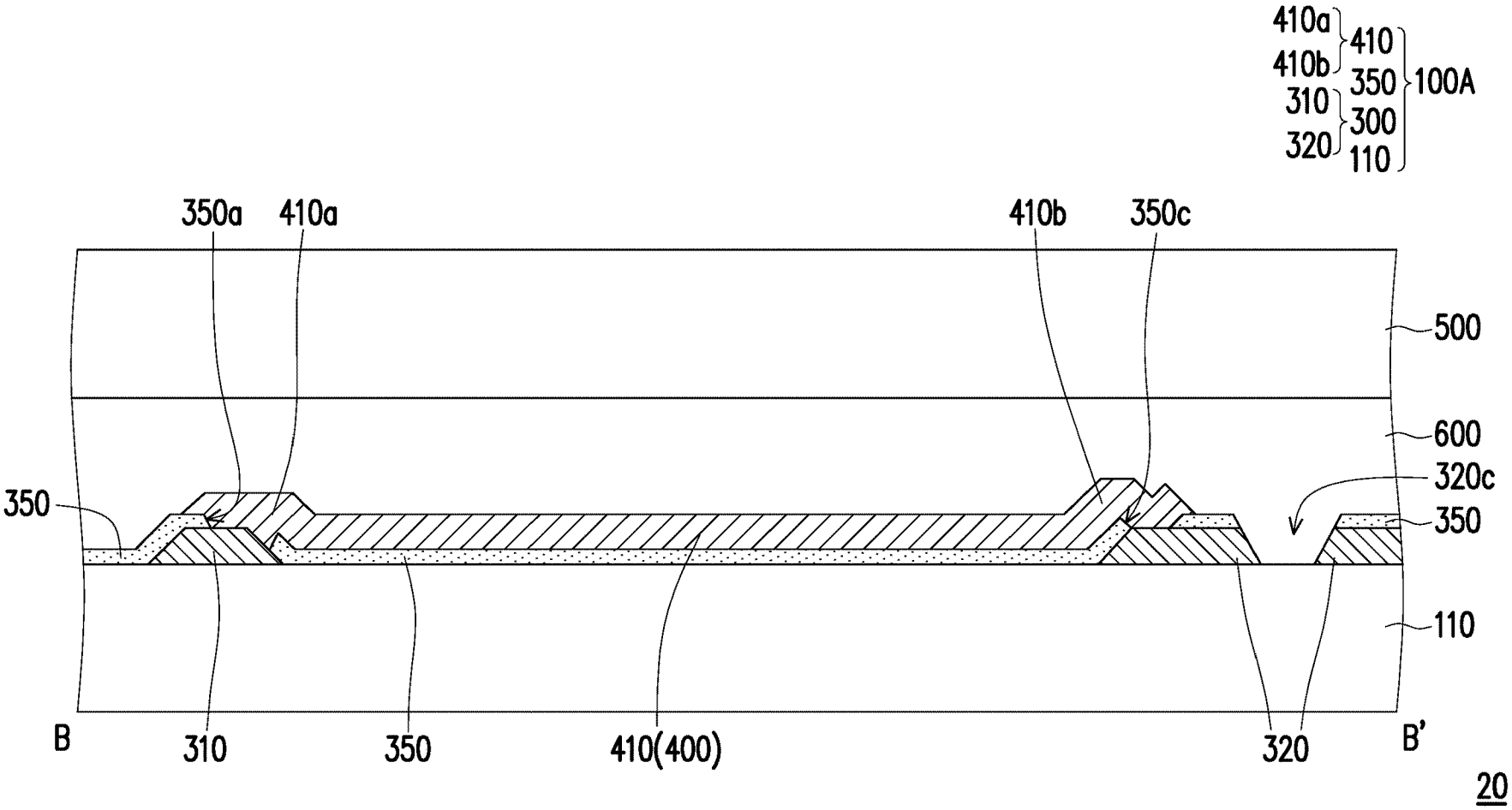
FIG. 5 is a schematic cross-sectional view of the partial area of the display apparatus in FIG. 4.

FIG. 4 is a schematic enlarged view of a partial area of a display apparatus 20 according to a second embodiment of the invention. FIG. 5 is a schematic cross-sectional view of the partial area of the display apparatus 20 in FIG. 4. FIG. 5 corresponds to a section line B-B' depicted in FIG. 4.

With reference to FIG. 4 and FIG. 5, the difference between the display apparatus 20 provided in the present embodiment and the display apparatus 10 depicted in FIG. 2 lies in that the manufacturing process of the display apparatus 20 provided in the present embodiment merely includes one welding process. Particularly, in the present embodiment, the first ends 410*a* of the auxiliary lines 410 of a pixel array substrate 100A are electrically coupled to the first scan indication signal transmission line 310 through welding, the insulating layer 350 of the pixel array substrate 100A has the contact window 350*c* overlapped with the first subsidiary transmission lines 320, and the second ends 410*b* of the auxiliary lines 410 fill the contact window 350*c* of the insulating layer 350, so as to be electrically coupled to the first subsidiary transmission lines 320. According to the present embodiment, note that the contact window 350*c* of the insulating layer 350 is formed in an etching process with use of one mask.

Figure 6:
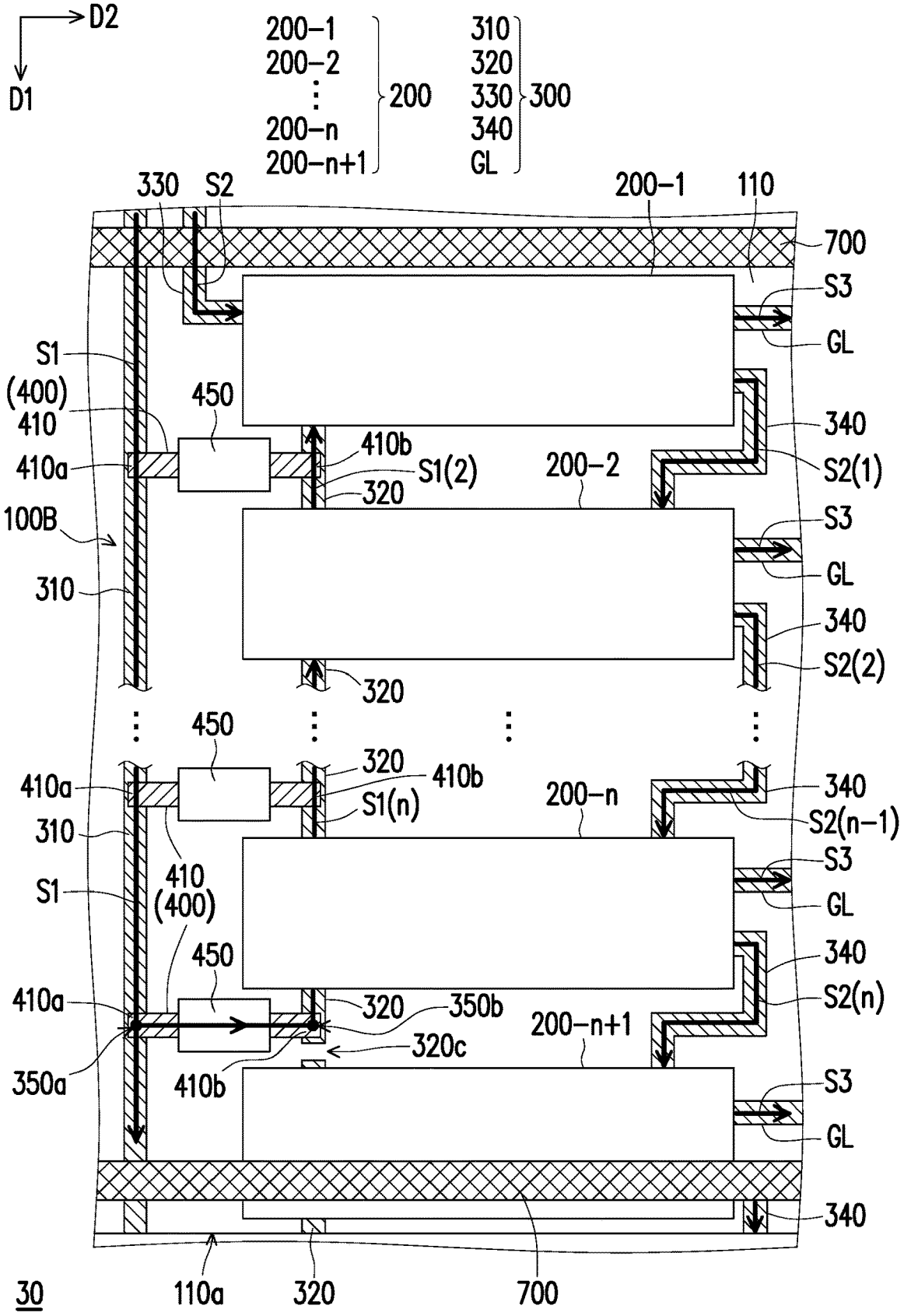
FIG. 6 is a schematic enlarged view of a partial area of a display apparatus according to a third embodiment of the invention.

FIG. 6 is a schematic enlarged view of a partial area of a display apparatus 30 according to a third embodiment of the invention. With reference to FIG. 6, the difference between the display apparatus 30 provided in the present embodiment and the display apparatus 10 depicted in FIG. 2 lies in that the display apparatus 30 provided in the present embodiment further includes a plurality of protection devices 450, and the manufacturing process of the display apparatus 30 does not include any cutting process. Particularly, in the pixel array substrate 100B, each auxiliary line 410 is serially connected to at least one of the protection devices 450. In the present embodiment, the protection devices 450 include diodes, for instance, which should however not be construed as a limitation to the invention.

To be more specific, in the present embodiment, the first subsidiary transmission line 320 coupled to the $n^{th}$ gate driver 200-*n* and the $(n+1)^{th}$ gate driver 200-*n*+1 does not have the break point 320*c*, and the protection devices 450 are disposed between the first ends 410*a* and the second ends 410*b* of the auxiliary lines 410. In particular, the protection devices 450 (e.g., diodes) may block the electric current flowing from the second ends 410*b* of the auxiliary lines 410 to the first ends 410*a* of the auxiliary lines 410. Thereby, signals on the selected auxiliary line 410 can be prevented from being interfered (e.g., signal interference of the dummy $(n+1)^{th}$ gate driver 200-*n*+1).

Figure 7:
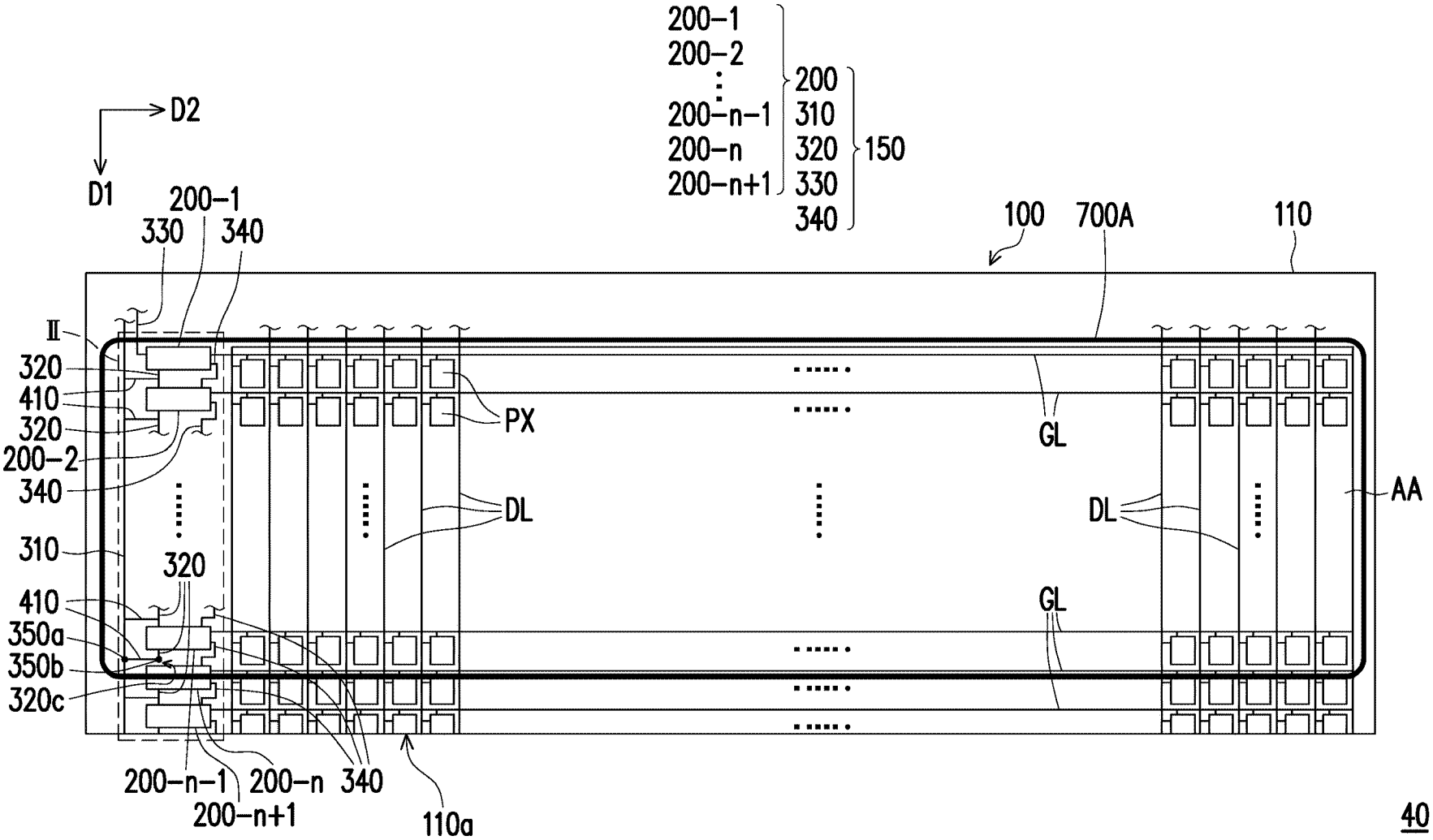
FIG. 7 is a schematic view of a display apparatus according to a fourth embodiment of the invention.
Figure 8:
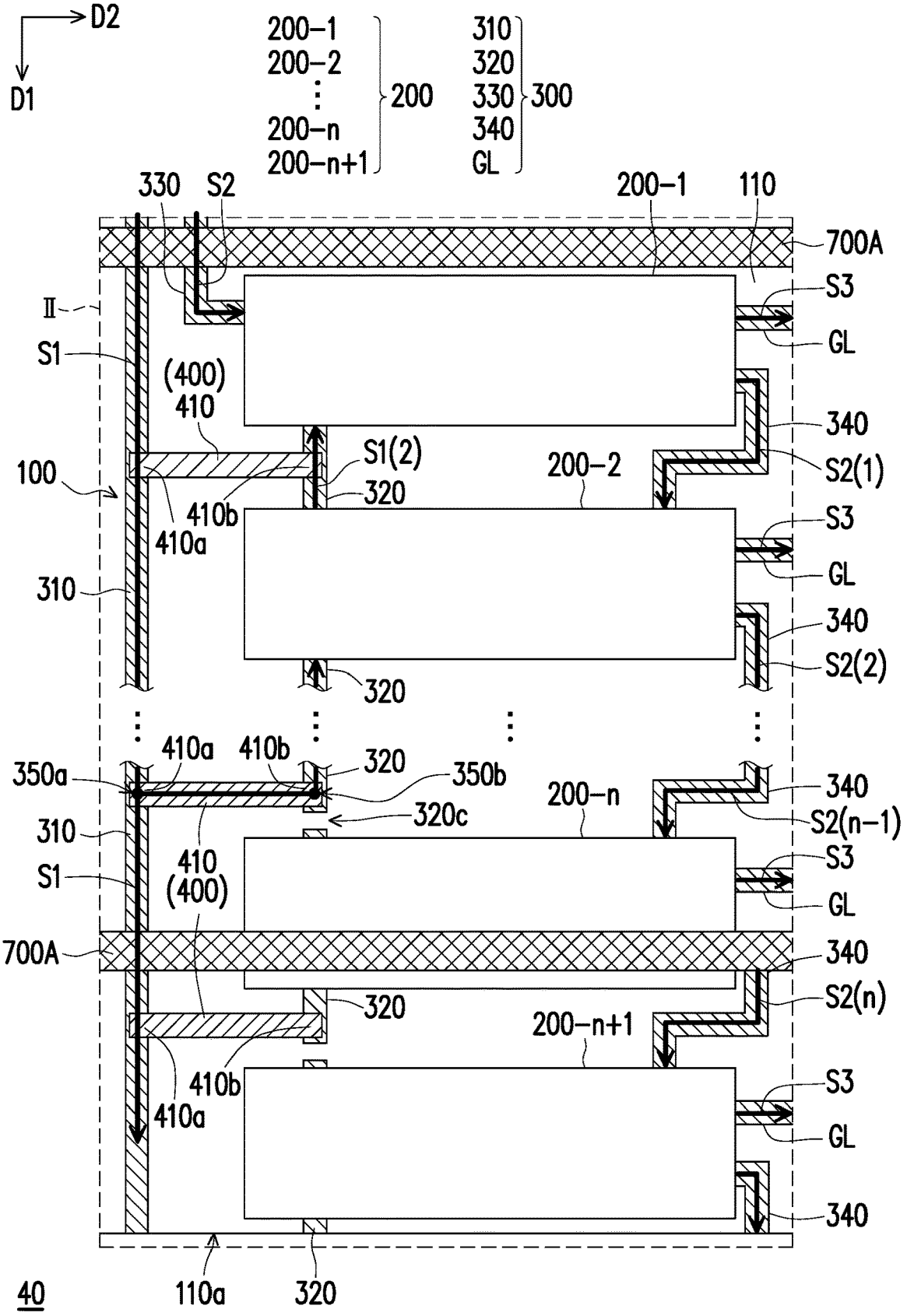
FIG. 8 is a schematic enlarged view of a partial area II of the display apparatus in FIG. 7.

FIG. 7 is a schematic view of a display apparatus 40 according to a fourth embodiment of the invention. FIG. 8 is a schematic enlarged view of a partial area III of the display apparatus 40 in FIG. 7. Particularly, the $(n-1)^{th}$ gate driver 200-*n*−1 depicted in FIG. 7 is omitted in FIG. 8.

With reference to FIG. 7 and FIG. 8, the display apparatus 40 provided in the present embodiment and the display apparatus 10 depicted in FIG. 1 lies in that the orthogonal projection of the $(n+1)^{th}$ gate driver 200-*n*+1 of the display apparatus 40 provided in the present embodiment in the first substrate 110 is located outside the orthogonal projection of the region surrounded by the sealing member 700A in the first substrate 110. In detail, according to the present embodiment, the first scan indication signal transmission line 310 is electrically coupled to the first subsidiary transmission line 320 through the auxiliary line 410 disposed between the $(n-1)^{th}$ gate driver 200-*n*−1 and the $n^{th}$ gate driver 200-*n*, and the number of the dummy gate drivers 200 is two, i.e., the $n^{th}$ gate driver 200-*n* and the $(n+1)^{th}$ gate driver 200-*n*+1.

Figure 9:
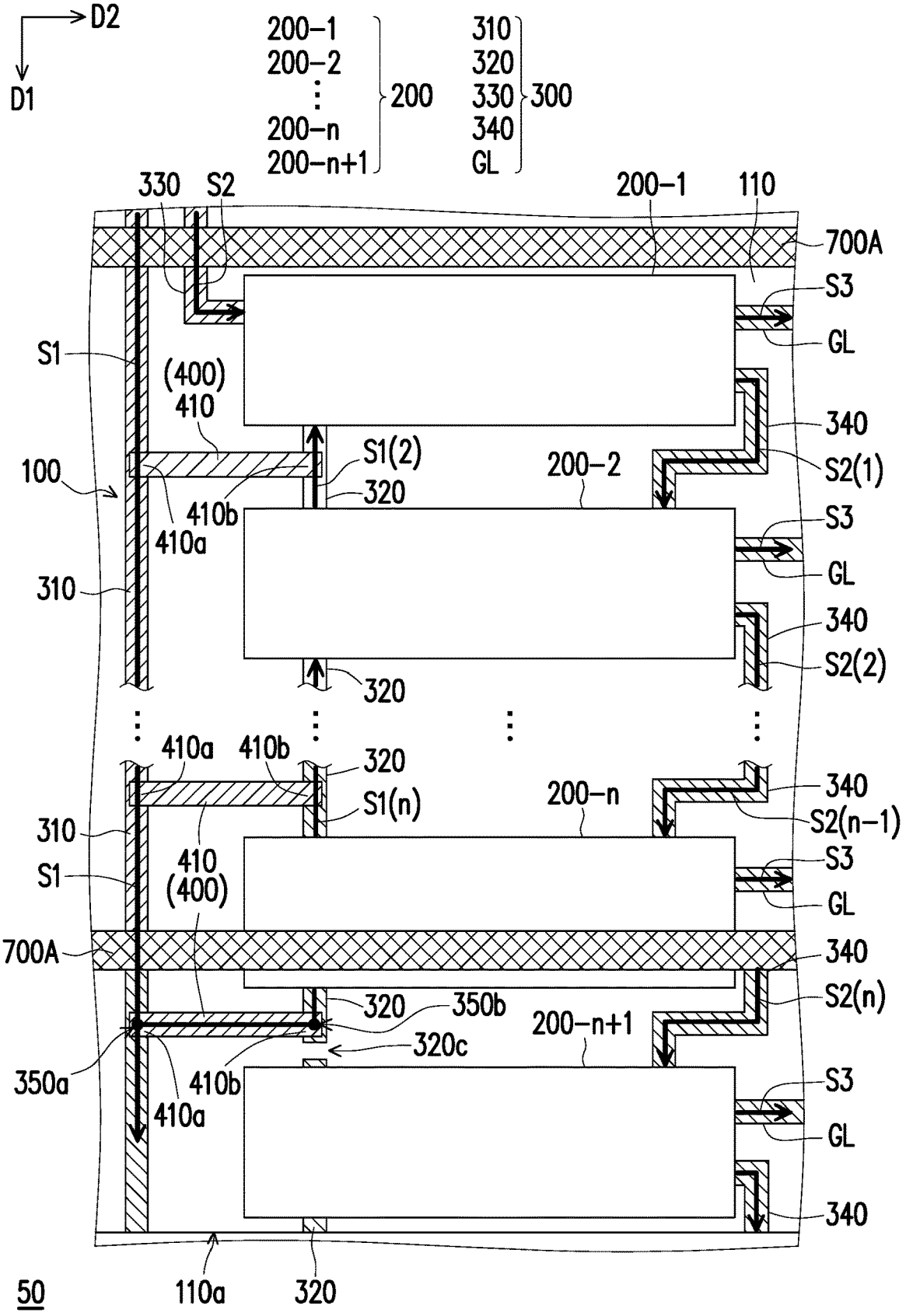
FIG. 9 is a schematic enlarged view of a partial area of a display apparatus according to a fifth embodiment of the invention.

FIG. 9 is a schematic enlarged view of a partial area of a display apparatus 50 according to a fifth embodiment of the invention. With reference to FIG. 9, the difference between the display apparatus 50 provided in the present embodiment and the display apparatus 40 depicted in FIG. 8 lies in that the orthogonal projection of the break point 320*c* of the first subsidiary transmission line 320 of the display apparatus 50 provided in the present embodiment in the first substrate 110 and the orthogonal projection of the auxiliary line 410 coupled between the first scan signal indication signal transmission line 310 and the first subsidiary transmission line 320 are located outside the orthogonal projection of the region surrounded by the sealing member 700A in the first substrate 110. Besides, the number of the dummy gate driver 200 is one, i.e., the $(n+1)^{th}$ gate driver 200-*n*+1.

Figure 10:
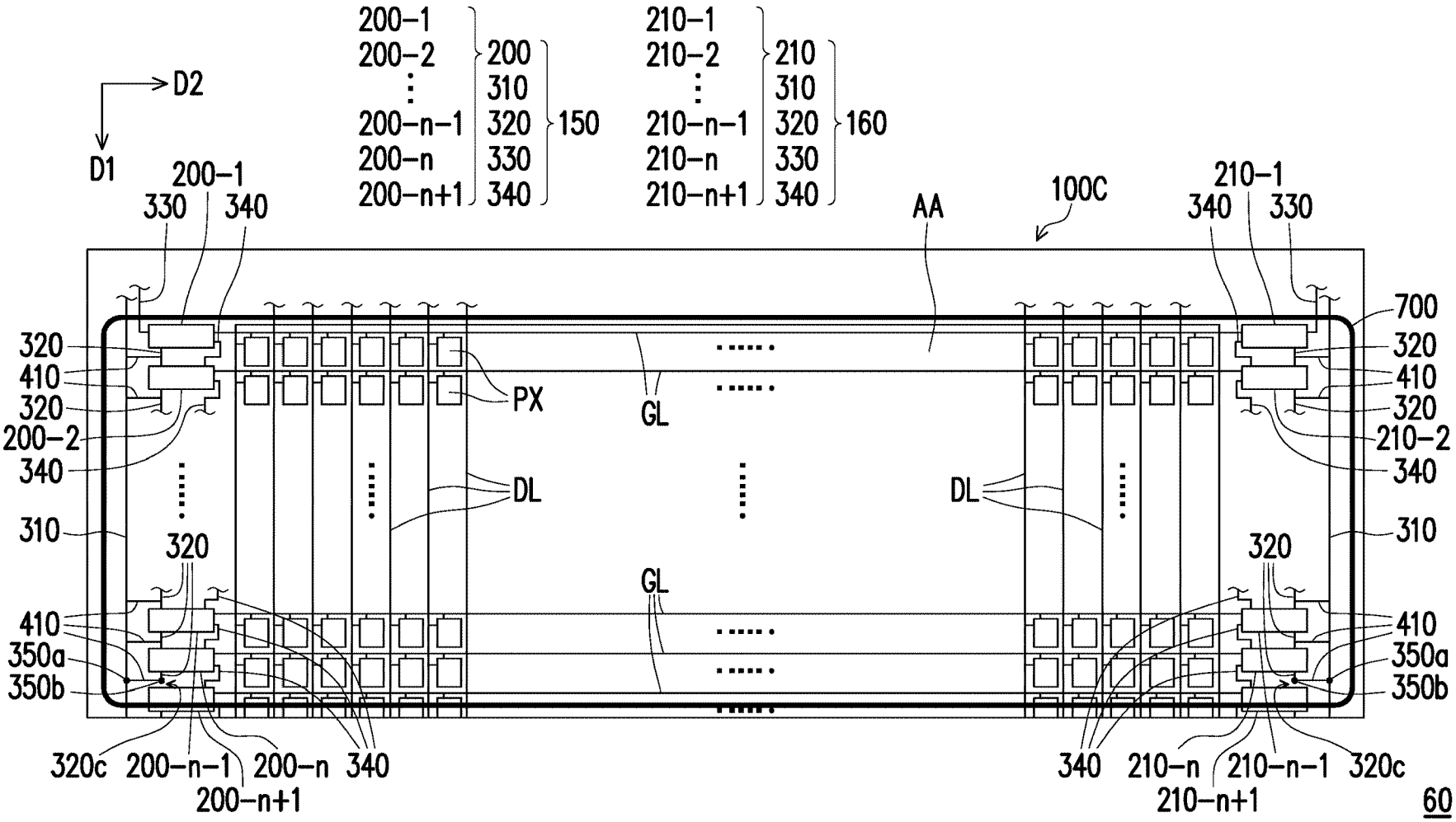
FIG. 10 is a schematic view of a display apparatus according to a sixth embodiment of the invention.

FIG. 10 is a schematic view of a display apparatus 60 according to a sixth embodiment of the invention. With reference to FIG. 10, the difference between the display apparatus 60 provided in the present embodiment and the display apparatus 10 depicted in FIG. 1 lies in that a pixel array substrate 100C of the display apparatus 60 provided in the present embodiment further includes a second gate driving circuit 160, and the first gate driving circuit 150 and the second gate driving circuit 160 are respectively disposed on two opposite sides of the display area AA of the first substrate 110. In the present embodiment, the second gate driving circuit 160 includes a plurality of gate drivers 210 coupled to a plurality of scan lines GL. Specifically, two ends of each scan line GL are respectively coupled to one gate driver 200 corresponding to the first gate driving circuit 150 and one gate driver 210 corresponding to the second gate driving circuit 160.

For instance, in the present embodiment, the gate driver 200-1 of the first gate driving circuit 150 and the gate driver 210-1 of the second gate driving circuit 160 are respectively coupled to two ends of one scan line GL, the second gate driver 200-2 of the first gate driving circuit 150 and the second gate driver 210-2 of the second gate driving circuit 160 are respectively coupled to two ends of another scan line GL, and the rest can be deduced therefrom. However, the invention is not limited thereto. In other embodiments, the gate drivers 200 of the first gate driving circuit 150 may be respectively coupled to the odd-numbered scan lines of the scan lines GL, and the gate drivers 210 of the second gate driving circuit 160 may be respectively coupled to the even-numbered scan lines of the scan lines GL.

To sum up, at least one of the first end and the second end of the selected auxiliary line among the auxiliary lines in the display apparatus provided in one or more embodiments of the invention is electrically coupled to the first scan indication signal transmission line and at least one of the corresponding first subsidiary transmission lines through welding, so that the first scan indication signal is allowed to be transmitted to the gate drivers through the selected auxiliary line. As such, the normal operation of the gate drivers can be ensured, and the reliability of the gate drivers which are being operated for a long time can be effectively improved.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. A display apparatus comprising:

a plurality of gate drivers sequentially coupled in series to each other;

a scan indication signal transmission line configured to transmit a scan indication signal;

a plurality of subsidiary transmission lines sequentially coupled between two adjacent gate drivers of the plurality of gate drivers, respectively; and a plurality of auxiliary lines respectively disposed between the scan indication signal transmission line and the plurality of subsidiary transmission lines, wherein one of the plurality of auxiliary lines is selected to be electrically coupled to the scan indication signal transmission line and a corresponding subsidiary transmission line of the plurality of subsidiary transmission lines, and the subsidiary transmission line electrically coupled to the selected auxiliary line has a break point, and the break point divides the subsidiary transmission line into two separate parts.

2. The display apparatus of claim 1, wherein the scan indication signal is a termination signal.

3. The display apparatus of claim 1, wherein two ends of each of the plurality of auxiliary lines are respectively overlapped with the scan indication signal transmission line and the corresponding subsidiary transmission line.

4. The display apparatus of claim 1, further comprising an insulating layer disposed between the plurality of auxiliary lines and the scan indication signal transmission line.

5. The display apparatus of claim 4, wherein the insulating layer is disposed between the plurality of auxiliary lines and the plurality of subsidiary transmission lines.

6. The display apparatus of claim 1, wherein a first end of the selected auxiliary line is electrically coupled to the scan indication signal transmission line, a second end of the selected auxiliary line is electrically coupled to the corresponding subsidiary transmission line, and at least one of the first end and the second end of the selected auxiliary line is electrically coupled to the scan indication signal transmission line and the corresponding subsidiary transmission line through welding.

7. The display apparatus of claim 1, wherein the subsidiary transmission line is coupled between an nth gate driver and an (n+1)th gate driver of the plurality of gate drivers, and the break point of the subsidiary transmission line is located between the selected auxiliary line and the (n+1)th gate driver, wherein n is a positive integer.

8. The display apparatus of claim 1, further comprising:

a sealing member surrounding a portion of the plurality of gate drivers, wherein an orthogonal projection of the selected auxiliary line is located outside an orthogonal projection of the portion surrounded by the sealing member, and an orthogonal projection of a portion of one of the gate drivers is located outside the orthogonal projection of the portion surrounded by the sealing member.

9. The display apparatus of claim 1, further comprising:

a plurality of protection devices, wherein each of the plurality of auxiliary lines is serially connected to at least one of the plurality of protection devices.

10. The display apparatus of claim 9, wherein a first end of the selected auxiliary line is electrically coupled to the scan indication signal transmission line, a second end of the selected auxiliary line is electrically coupled to the corresponding subsidiary transmission line, and at least one of the first end and the second end of the selected auxiliary line is electrically coupled to the scan indication signal transmission line and the corresponding subsidiary transmission line through welding.

11. The display apparatus of claim 10, wherein the subsidiary transmission line is coupled between an nth gate driver and an (n+1)th gate driver of the plurality of gate drivers, and a break point of the subsidiary transmission line is located between the selected auxiliary line and the (n+1)th gate driver.

12. The display apparatus of claim 1, further comprising a display area, wherein one portion of the plurality of gate drivers and another portion of the plurality of gate drivers are respectively disposed on two opposite sides of the display area.

13. The display apparatus of claim 9, wherein the protection devices are diodes.

14. A display apparatus comprising:

a plurality of gate drivers sequentially coupled in series to each other, wherein the plurality of gate drivers are sequentially arranged along a first direction, and the plurality of gate drivers sequentially provide the gate driving signals to scan lines in a second direction opposite to the first direction;

a first scan indication signal transmission line configured to transmit a first scan indication signal, wherein the first scan indication signal is one of a termination signal and a start signal;

a second scan indication signal transmission line configured to transmit a second scan indication signal, wherein the second scan indication signal is another one of the termination signal and the start signal;

a plurality of subsidiary transmission lines sequentially coupled between two adjacent gate drivers of the plurality of gate drivers, respectively; and a plurality of auxiliary lines respectively disposed between the first scan indication signal transmission line and the plurality of subsidiary transmission lines, wherein one of the plurality of auxiliary lines is selected to be electrically coupled to the first scan indication signal transmission line and a corresponding subsidiary transmission line of the plurality of subsidiary transmission lines.

15. A display apparatus comprising:

a plurality of gate drivers sequentially coupled in series to each other;

a scan indication signal transmission line configured to transmit a scan indication signal;

a plurality of subsidiary transmission lines sequentially coupled between two adjacent gate drivers of the plurality of gate drivers, respectively; and a plurality of auxiliary lines respectively disposed between the scan indication signal transmission line and the plurality of subsidiary transmission lines, wherein one of the plurality of auxiliary lines is selected to be electrically coupled to the scan indication signal transmission line and a corresponding subsidiary transmission line of the plurality of subsidiary transmission lines, and a sealing member surrounding a portion of the plurality of gate drivers, wherein an orthogonal projection of the selected auxiliary line is located outside an orthogonal projection of the portion surrounded by the sealing member, and an orthogonal projection of the selected auxiliary line is located outside an orthogonal projection of the portion surrounded by the sealing member.

16. A display apparatus comprising:

n+1 gate drivers sequentially coupled in series to each other, wherein n is positive integer;

a scan indication signal transmission line configured to transmit a scan indication signal;

a plurality of subsidiary transmission lines sequentially coupled between two adjacent gate drivers of the plurality of gate drivers, respectively; and a plurality of auxiliary lines respectively disposed between the scan indication signal transmission line and the plurality of subsidiary transmission lines, wherein one of the plurality of auxiliary lines is selected to be electrically coupled to the scan indication signal transmission line and a corresponding subsidiary transmission line of the plurality of subsidiary transmission lines, wherein the subsidiary transmission line electrically coupled to the selected auxiliary line has a break point, wherein the break point substantially located between the $n^{th}$ gate driver and the $(n+1)^{th}$ gate driver is configured to break the connection of the $(n+1)^{th}$ gate driver and the selected auxiliary line.

* * * * *